US007339132B2

(12) United States Patent
Urai et al.

(10) Patent No.: US 7,339,132 B2
(45) Date of Patent: Mar. 4, 2008

(54) METHOD OF CURRENT INTERRUPTION USING PUFFER TYPE GAS CIRCUIT BREAKER WITH COMBINED-ACTION OF CYLINDER AND PISTON

(75) Inventors: Hajime Urai, Hitachi (JP); Youichi Ohshita, Hitachinaka (JP); Makoto Koizumi, Naka (JP); Naoki Osawa, Hitachi (JP); Hiroaki Hashimoto, Kasumigaura (JP); Junzo Kida, Hitachi (JP)

(73) Assignee: Japan AE Power Systems Corporation, Tokyo (JP)

( * ) Notice: Subject to any disclaimer, the term of this patent is extended or adjusted under 35 U.S.C. 154(b) by 0 days.

(21) Appl. No.: 11/294,579

(22) Filed: Dec. 6, 2005

(65) Prior Publication Data

US 2006/0151438 A1 Jul. 13, 2006

(30) Foreign Application Priority Data

Dec. 6, 2004 (JP) ..... 2004-352516

(51) Int. Cl.
*H01H 33/90* (2006.01)

(52) U.S. Cl. ..... 218/57; 218/59

(58) Field of Classification Search ..... 218/43, 218/45, 46, 51–57, 59–64, 66–73, 78–80, 218/84, 86, 88
See application file for complete search history.

(56) References Cited

U.S. PATENT DOCUMENTS

| | | | | |
|---|---|---|---|---|
| 4,329,553 A | | 5/1982 | Graf | |
| 4,458,120 A | | 7/1984 | Korner | |
| 5,293,014 A | * | 3/1994 | Perret | 218/57 |
| 5,304,762 A | | 4/1994 | Hiltbrunner | |
| 5,561,280 A | * | 10/1996 | Blatter | 218/59 |
| 5,587,571 A | | 12/1996 | Perret | |
| 5,723,839 A | | 3/1998 | Kozawa | |
| 5,898,149 A | | 4/1999 | Berger et al. | |
| 6,013,888 A | * | 1/2000 | Thuries | 218/14 |
| 6,342,685 B1 | | 1/2002 | Perret | |
| 6,624,370 B1 | | 9/2003 | Soga et al. | |
| 6,696,657 B2 | | 2/2004 | Hirose et al. | |

FOREIGN PATENT DOCUMENTS

| | | |
|---|---|---|
| JP | 63-88724 | 4/1988 |
| JP | 2000-268688 A | 9/2000 |
| JP | 2001-110291 A | 4/2001 |
| JP | 2001-357762 A | 12/2001 |
| JP | 2002-042618 A | 2/2002 |
| JP | 2002-245909 | 8/2002 |
| TW | 294817 | 1/1997 |
| TW | 460885 | 10/2001 |
| TW | 526507 | 4/2003 |
| TW | 536722 | 6/2003 |

* cited by examiner

*Primary Examiner*—Elvin Enad
*Assistant Examiner*—M. Fishman
(74) *Attorney, Agent, or Firm*—Mattingly, Stanger, Malur & Brundidge, P.C.

(57) ABSTRACT

A puffer type gas circuit breaker has a piston, which is connected with a center shaft via a link mechanism. At an initial stage of an interruption operation, the link mechanism drives a puffer cylinder and the piston both in an interruption direction while maintaining an almost constant distance therebetween. Even when a pressure rise occurs in a compression chamber by the heat of an arc generated in accordance with opening between a fixed arc contact and a movable arc contact, the pressure rise does not become an operation counterforce to an operator. At a final stage of the interruption operation where the fixed arc contact is removed from a throat of an insulating nozzle, the link mechanism drives the piston in an almost stopped status.

22 Claims, 5 Drawing Sheets

METHOD OF CURRENT INTERRUPTION USING PUFFER TYPE GAS CIRCUIT BREAKER WITH COMBINED-ACTION OF CYLINDER AND PISTON

CLAIM OF PRIORITY

This application claims priority from Japanese application serial No. 2004-352516, filed on Dec. 6, 2004, the content of which is hereby incorporated by reference into this application.

FIELD OF THE INVENTION

The present invention relates to a current interruption method for a puffer type gas circuit breaker having excellent interruption performance to interrupt a short-circuit current or the like in a high-voltage electric power system and a puffer type gas circuit breaker employed in the method.

BACKGROUND OF THE INVENTION

As a gas circuit breaker applied to a high-voltage electric power system, employed is a puffer type gas circuit breaker which performs extinguishment by blasting a quenching gas to an arc in association with a contact opening operation in an interruption part. When a short-circuit fault occurs in the electric power system and a short-circuit current flows, a trip signal is sent to this conventional puffer type gas circuit breaker. The puffer type gas circuit breaker receives the signal, then moves a movable main contact away from a fixed main contact forming a main current path with an operator using oil pressure or energy stored in a spring. Then the puffer type gas circuit breaker moves a movable arc contact from a fixed arc contact at a high speed, and at the same time, drives a puffer cylinder connected with an insulating rod so as to compress a quenching gas in a compression chamber formed with the insulating rod and a piston. Thereafter, the gas circuit breaker blasts the high-pressure quenching gas through an insulating nozzle to an arc ignited between the arc contacts, thereby interrupts the short-circuit current at an arc current zero point.

This puffer type gas circuit breaker obtains a stable high blast pressure. However, as the quenching gas heat-expanded by the heat of arc ignited between the arc contacts acts as a counterforce to the puffer cylinder to compress the quenching gas in the compression chamber, an operator having high operation energy is required to overwhelm the counterforce to ensure desired interruption performance. On the other hand, a puffer type gas circuit breaker applying heat of arc generated upon contact opening to a blast pressure is known. This puffer type gas circuit breaker is provided with a floating piston placed in a compression chamber via a spring, so as to control an extreme pressure rise due to the heat of arc by the operation of the floating piston (for example, see Patent Document 1).

[Patent Document 1] Japanese Patent Laid-Open No. S63(1988)-88724

However, in the above conventional puffer type gas circuit breaker, as the floating piston is placed in the compression chamber via the spring, the extreme pressure rise due to the heat of arc can be suppressed, but the operation characteristic of the floating piston based on the gas pressure is unstable. Accordingly, in this arrangement, stable blasting cannot be maintained, and stable interruption performance cannot be obtained without difficulty. For this reason, in a circuit breaker used in a high-voltage electric power system, to maintain a stable and high blast pressure upon quenching gas blasting as in the case of the general puffer type gas circuit breaker, it is necessary to form a compression chamber with a puffer cylinder and a piston so as to mechanically compress the quenching gas in the compression chamber in association with an interruption operation. Accordingly, as described above, an operator with high operation energy is required to perform an interruption operation while overwhelming the pressure rise in the compression chamber related to the interruption operation and the pressure rise in the compression chamber due to the heat of arc.

The present invention has been made in consideration of the above situation, and provides a current interruption method for a puffer-type gas circuit breaker for enabling downsizing of an operator and reduction of operation force, and for maintaining a stable and high blast pressure, and a puffer type gas circuit breaker employed in the method.

SUMMARY OF THE INVENTION

According to the present invention, provided is a current interruption method for a puffer-type gas circuit breaker, having at least a pair of arc contacts connected with an operator and opened by the operator, wherein when a quenching gas in a compression chamber formed with slidable cylinder and piston is compressed in accordance with an opening operation between the arc contacts, in cooperation with one of the cylinder and the piston, and the compressed quenching gas is guided through an insulating nozzle and blasted to an arc generated between the arc contacts, the method comprising: a maintaining step of, prior to blasting of the quenching gas, moving the position of the compression chamber in an interruption direction while maintaining an almost constant volumetric capacity in the compression chamber; and a compression step of, after the maintaining step, compressing the quenching gas while reducing the volumetric capacity in the compression chamber.

DETAILED DESCRIPTION OF THE PREFERRED EMBODIMENTS

Figure 1:
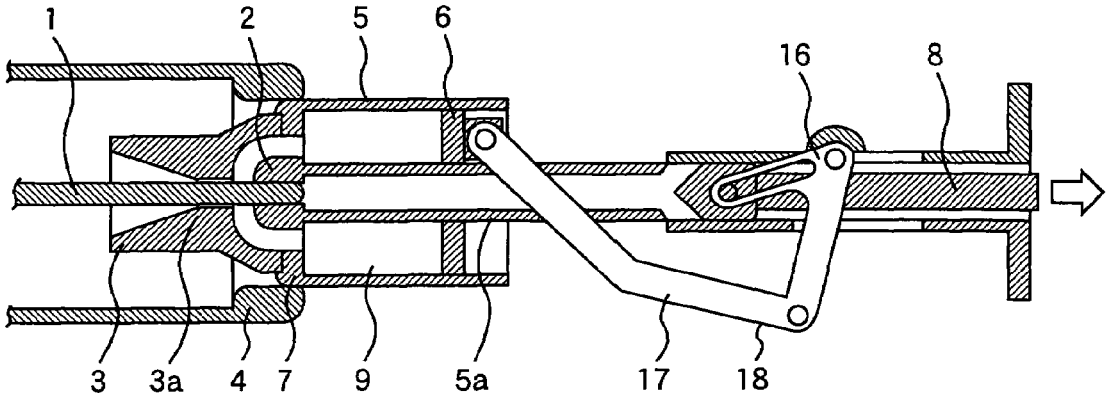
FIG. 1 is a cross-sectional view showing an initial status of a puffer type gas circuit breaker according to an embodiment of the present invention.

One of the aspects of the present invention is a method of interrupting current of a puffer type gas circuit breaker having at least a pair of arc contacts connected to an operator, which comprises: compressing arc quenching gas in a compression chamber formed by a cylinder and piston upon a separation movement of the arc contacts, one of which is slidably connected to the cylinder and piston and blasting the compressed gas guided through an insulating nozzle towards arc generated between the arc contacts thereby to interrupting current, which further comprises, before blasting the arc quenching gas, a holding step for moving the position of the compression chamber towards the interruption direction, keeping the volume of the compression chamber substantially constant, and then a compressing step for compressing the arc quenching gas, while reducing the volume of the compression chamber.

Still another aspect of the present invention is a current interruption method for a puffer-type gas circuit breaker according to the above aspect, wherein a throat of the insulating nozzle is clogged with the other arc contact, and when the other arc contact is removed from the throat upon the interruption operation, a blast flow is formed via the throat from the compression chamber, and wherein the holding step is performed for at least a part of a period before the other arc contact is removed from the throat.

The present invention provides a current interruption method for a puffer-type gas circuit breaker according to claim 1, wherein the holding step further includes a step of enlarging the volume of the compression chamber.

The present invention provides a puffer type gas circuit breaker comprising:

at least a pair of arc contacts, disposed in an airtight container filled with a quenching gas, the arc contacts being separable from each other;

an operator that drives at least one of the arc contacts in a separation direction;

compression means, slidably connected with one of a cylinder and piston connected with the operator, for compressing the quenching gas in a compression chamber formed by the cylinder and piston, upon the separation operation between the arc contacts; and an insulating nozzle whose throat is substantially clogged with one of the arc contacts not connected to the cylinder nor to the piston, the insulating nozzle guiding the quenching gas compressed by the compression means to blast the quenching gas to an arc generated between the arc contacts, wherein provided is a link mechanism one end of which is connected with the operator and the other end of which is connected with one of the cylinder and piston, and wherein the link mechanism branches an operation force of the operator at an initial stage of an interruption operation and drives one of the cylinder and piston in an interruption operation direction, followed by almost stopping one of the cylinder and piston.

One of the aspect of the present invention is a puffer type gas circuit breaker comprising:

at least a pair of arc contacts, disposed in an airtight container filled with a quenching gas, the arc contacts being separable from each other;

an operator that drives at least one of the arc contacts in a separation direction;

compression means, slidably connected with one of cylinder and piston connected with the operator, for compressing the quenching gas in a compression chamber formed with the cylinder and the piston, upon a separation operation between the arc contacts; and an insulating nozzle a throat of which is clogged with the other arc contact not connected to the cylinder nor to the piston, the insulating nozzle guiding the quenching gas compressed by the compression means to blast the quenching gas to an arc generated between the arc contacts, wherein a link mechanism is provided between the operator and one of the cylinder and piston, and wherein the link mechanism drives the cylinder and the piston both in an interruption direction while holding a predetermined distance between one of the cylinder and piston and the other of the cylinder and piston before the other arc contact not connected to the cylinder nor to the piston is removed from the throat of the insulating nozzle upon the interruption operation.

Another aspect of the present invention is a puffer type gas circuit breaker according to the above aspect, wherein the link mechanism fixes the one of the cylinder and piston so as to compress the quenching gas in the compression chamber when the other arc contact is separated from the throat of the insulating nozzle.

Hereinafter, preferred embodiments of the present invention will now be described in detail in accordance with the accompanying drawings.

First, a current interruption method for a puffer type gas circuit breaker according to the present invention will be described.

As described above, generally, in a puffer type gas circuit breaker, the contact opening operation and the quenching-gas compression operation in the compression chamber are approximately simultaneously performed. In this arrangement, to drive the contact to the position where it is quickly removed from the throat of the insulating nozzle, i.e., the gas blast position, overwhelming the operation counterforce generated by the pressure rise in the compression chamber, an operator, which generates a powerful operation force is required. Further, as the pressure rise occurs by the heat of arc generated by the contact opening in the compression chamber in addition to the mechanical pressure rise by the operator, a powerful operation force overwhelming these pressure rises is required. Accordingly, the inventors have studied time elements of the contact opening operation and the quenching-gas compression operation in the compression chamber, and arranged the present current interruption method such that it includes the holding step of driving the cylinder and piston forming the compression chamber both in an interruption direction while maintaining an almost constant volumetric capacity in the compression chamber, almost without mechanical compression, until an intermediate stage of interruption operation before one of the contacts has been removed from the throat of the insulating nozzle, and the compression step of, thereafter, reducing the volumetric capacity in the compression chamber to compress the quenching gas in the compression chamber.

According to the current interruption method for a puffer type gas circuit breaker, as the cylinder and the piston forming the compression chamber are both driven in the interruption direction until the intermediate stage of the interruption operation, even when the pressure rise occurs due to the heat of arc generated by the contact opening operation, the pressure rise does not become the operation counterforce to the operator. Accordingly, as the powerful operation force is not required from the initial stage of the interruption operation as in the case of the conventional art, a small operator with a low operation force can be employed. Further, the pressure rise in the compression chamber by the heat of arc can be accumulated and utilized in the later gas blast to the arc. Further, when the mechanical compression in the compression chamber is performed at the final stage of the interruption operation, an operation counterforce to the operator is generated. However, as the operation of the interruption part movable portion interruption direction has been sufficiently accelerated at the previous holding step, and one of the contacts has been removed from the throat of the insulating nozzle to form a blast gas flow to the arc, the compression value in the compression chamber has been already off-peak, and the above-described powerful operation counterforce can be avoided. Thus the blast gas can be supplied for long time in a stable manner, and the interruption performance can be improved.

FIG. 1 is a cross-sectional view of a puffer type gas circuit breaker according to an embodiment realizing the above-described the current interruption method for a puffer type gas circuit breaker of the present invention.

The puffer type gas circuit breaker is arranged in an airtight container (not shown) filled with a quenching gas. In the puffer type gas circuit breaker, a fixed arc contact 1 as an arc generator is connected with one terminal, and a fixed main contact 4 forming a main current path is provided around the contact 1. On the other hand, a puffer cylinder 5 (details are omitted) is provided horizontally-movably, on the other terminal in a maintained electrical connection status. A movable main contact 7 is attached to a shoulder of the puffer cylinder 5, and a movable arc contact 2 is attached to a center shaft 5*a* of the puffer cylinder 5. An operator (not shown) is connected with the center shaft 5*a* of the puffer cylinder 5 via an insulating rod 8. The operator transmits an opening/closing operation force to the movable main contact 7 and the movable arc contact 2. A piston 6 is provided in a slidable relation on the inner surface of the puffer cylinder 5. The piston 6 and the puffer cylinder 5 form a compression chamber 9. The piston 6 is connected via a link mechanism 18 with the center shaft 5*a* connected with the operator.

The link mechanism 18 branches and transmits an interruption operation force from the operator to the piston 6. The link mechanism 18 is arranged so as to drive the piston 6 to hold an almost constant distance to the puffer cylinder 5 and to maintain an almost constant volumetric capacity in the compression chamber 9 from an initial stage of an interruption operation where the interruption operation is started to an intermediate stage of the interruption operation where the fixed arc contact 1 is removed from a throat 3*a* of an insulating nozzle 3, thereafter, at a final stage of the interruption operation, to drive the piston 6 is an almost fixed status to compress the quenching gas in the compression chamber 9, as a series of operation characteristics. To maintain an almost constant distance between the piston 6 and an end wall of the puffer cylinder 5 means unpositive conduction of mechanical compression of the quenching gas in the compression chamber, and further, this includes a case where the both members are driven in an interruption direction at approximately the same speed, a case where the piston 6 is driven in a direction to enlarge the volumetric capacity in the compression chamber 9 at the initial stage of the interruption operation, and a case where the piston 6 is driven in a direction to enlarge the volumetric capacity in the compression chamber 9 at the initial stage of the interruption operation then the piston 6 is driven to maintain an almost constant distance to the puffer cylinder 5 and maintain an almost constant volumetric capacity in the compression chamber 9 at the intermediate stage of the interruption operation.

The link mechanism 18 has an almost V-shaped link 17 and an L-shaped lever 16 connected between the piston 6 and the center shaft 5*a*. More specifically, one end of the link 17 is mechanically connected with the piston 6, the other end of the link 17 is connected to one end of the lever 16, and the other end of the lever 16 is connected with the center shaft 5*a* with a pin in an elliptic groove formed in the other end of the lever 16. The above-described puffer cylinder 5, mechanically and directly connected with the center shaft 5*a* and the insulating rod 8, shows the same operation characteristic as that of the insulating rod 8, while the piston 6 shows a different operation characteristic from that of the insulating rod 8 by the link mechanism 18 having the lever 16 and the link 17.

Assuming that the insulating rod 8 is driven rightward with the operator (not shown), first, the movable main contact 7 is moved away from the fixed main contact 4, then the movable arc contact 2 is moved away from the fixed arc contact 1. At this initial stage of the interruption operation, the puffer cylinder 5 moves in a direction to compress the quenching gas in the compression chamber 9 with the contact opening operation. However, as the piston 6 is not fixed but connected with the insulating rod 8 via the link mechanism 18, the piston 6 is moved with the link mechanism 18 at a speed slightly higher than that of the puffer cylinder 5 in the same direction. Accordingly, the pressure rise characteristic of the quenching gas in the compression chamber 9 is different from that in the conventional art.

Figure 2:
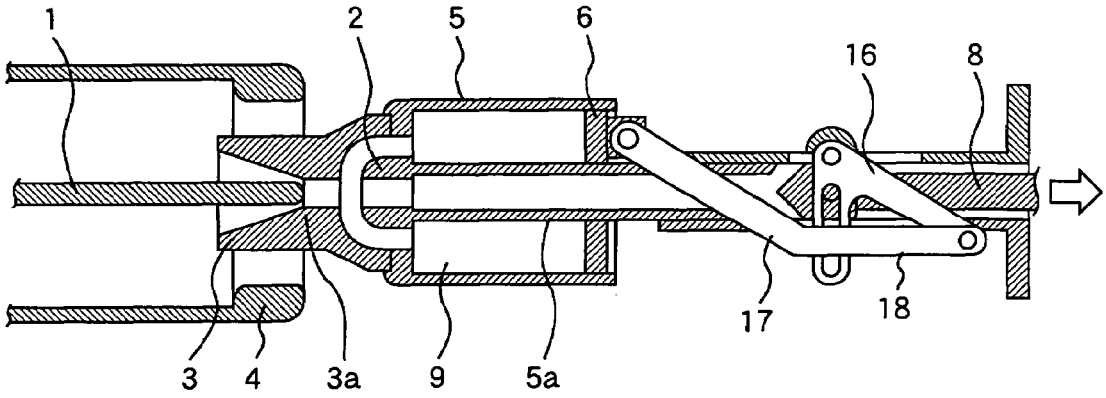
FIG. 2 is a cross-sectional view showing an intermediate status of an interruption operation by the puffer type gas circuit breaker in FIG. 1.

In this embodiment, when the center shaft 5*a* moves in an interruption direction with the insulating rod 8, the puffer cylinder 5 moves in the interruption direction in correspondence with the specification of the operator as in the case of the conventional art, while the piston 6 conducts its specific movement with the link mechanism 18. That is, the center shaft 5*a* rotates the lever 16 in a counterclockwise direction while moving in the elliptic groove in the connecting portion with the lever 16. As shown in FIG. 2, the rotation of the lever 16 at this time moves the connecting portion between the lever 16 and the link 17 in the interruption direction, which is transmitted via the link 17 to the piston 6. In this manner, the piston 6 moves in the same direction as that in which the puffer cylinder 5 moves with the link mechanism having the lever 16 and the link 17.

Further, as it is understood from FIG. 2, the movement of the piston 6 in the interruption direction at the initial stage of the interruption operation is conducted at the speed slightly higher than that of the puffer cylinder 5. Accordingly, until the intermediate stage of the interruption operation immediately before the fixed arc contact 1 is removed from the throat 3*a* of the insulating nozzle 3, as the relative positional relation between the puffer cylinder 5 and the piston 6, the position of the piston 6 from the puffer cylinder 5 is farther than that in FIG. 1 showing the initial status, and the volumetric capacity in the compression chamber 9 is larger than that in FIG. 1. As it is apparent from the description, to drive the piston 6 in the interruption direction at a higher speed than that of the puffer cylinder 5 means increasing the volumetric capacity in the compression chamber 9 and non-execution of mechanical compression of the quenching gas in the compression chamber 9.

When the interruption current is high, the pressure in the compression chamber 9 rises due to temperature rise and pressure rise caused by an arc generated with the opening between the fixed arc contact 1 and the movable arc contact 2. However, at the initial stage and the intermediate stage of the interruption operation, as the puffer cylinder 5 and the piston 6 are both moved in the interruption direction while the relative positional relation is maintained, the mechanical compression is not performed in the compression chamber 9, and the compression rise in the compression chamber 9 does not become an operation counterforce to the operator. The compression chamber 9 having the enlarged volumetric capacity sufficiently absorbs the rapid pressure rise by the heat of arc, and maintains the pressure.

In this manner, the above construction is different from the conventional art where the pressure rise by the heat of arc is added to the pressure rise by the mechanical compression in the compression chamber 9 and an extreme operation counterforce to the operator is generated. In the conventional art, a large operator which generates an operation force for driving in the interruption direction overwhelming the extreme pressure rise is required, however, in the above-described construction, a puffer type gas circuit breaker, using a small operator with a low operation force, can be realized by reducing the operation counterforce.

As described above, from the initial stage of the interruption operation to the intermediate stage of the interruption operation, the link mechanism 18 drives the piston 6 in the direction where the piston 6 is moved away from the puffer cylinder 5 by a predetermined distance, but as a whole, drives the piston 6 in the interruption direction in a range where an almost constant distance to the puffer cylinder 5 is maintained so as to maintain an almost constant volumetric capacity in the compression chamber 9. As it is understood from this explanation, as another embodiment, it may be arranged such that the link mechanism 18 drives the piston 6 in the direction where the piston 6 is moved away from the puffer cylinder 5 by a predetermined distance only at the initial stage of the interruption operation, but at the intermediate stage of the interruption operation, drives the piston 6 in the interruption direction so as to maintain an almost constant distance to the puffer cylinder 5 and maintain an almost constant volumetric capacity in the compression chamber 9.

In any case, the pressure in the compression chamber 9 rises until the intermediate stage of the interruption operation, but as the puffer cylinder 5 and the piston 6 are both moved in approximately the same direction, an operation counterforce to the operator is not generated. Accordingly, by reducing the operation counterforce from the initial stage to the intermediate stage of the interruption operation, a small operator with a low operation force can be employed. Further, the mechanical compression of the quenching gas in the compression chamber 9 is almost not performed, a small operator with a low operation force in comparison with the conventional art can be employed.

Figure 3:
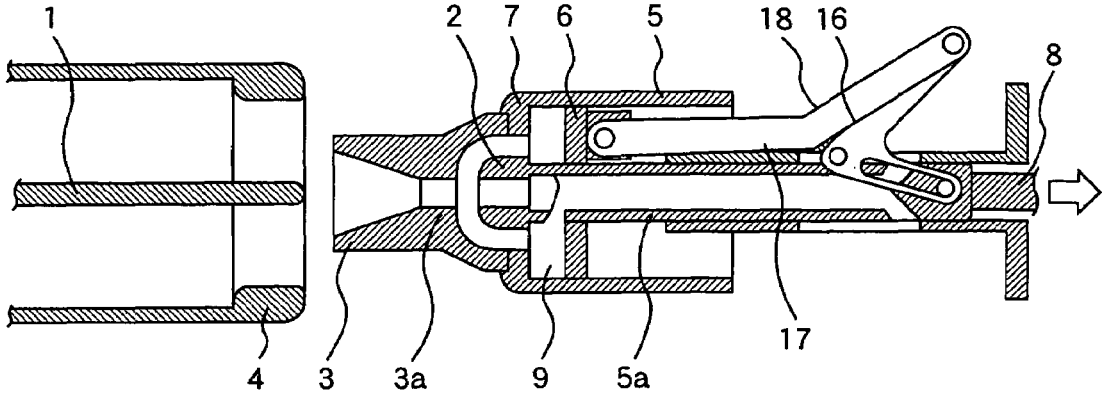
FIG. 3 is a cross-sectional view showing a final status of the interruption operation by the puffer type gas circuit breaker in FIG. 1.

However, at the final stage of the interruption operation, i.e., when the fixed arc contact 1 has been removed from the throat 3*a* of the insulating nozzle 3 as shown in FIG. 2, the link mechanism 18 drives the piston 6 in a fixed status to the puffer cylinder 5 almost from this time. Accordingly, the distance between the puffer cylinder 5 and the piston 6 is gradually reduced, and the quenching gas in the compression chamber 9 is mechanically compressed at the final stage of the interruption operation. That is, at the final stage of the interruption operation, the connecting portion between the lever 16 and the link 17 conducts an arc-wise movement with the connecting portion between the piston 6 and the link 17 as a center as shown in FIGS. 2 and 3. As it is understood from a comparison between FIG. 2 and FIG. 3 showing the subsequent status of FIG. 2, the piston 6 is prevented from moving in the interruption direction and is in the almost fixed status. At this time, as the elliptic groove is formed in the connecting portion between the lever 16 and the center shaft 5*a*, only the center shaft 5*a* further moves in the interruption direction. Thus, as the movement of the connecting portion between the lever 16 and the link 17 is almost stopped, and the movement of the piston 6 in the interruption direction is almost stopped, at the final stage of the interruption operation, the movement of the center shaft 5*a* in the interruption direction compresses the quenching gas in the compression chamber 9 with the puffer cylinder 5.

When the compression of the quenching gas in the compression chamber 9 is performed, the fixed arc contact 1 has almost been removed from the throat 3*a* of the insulating nozzle 3, and a blast gas flow is formed around from the compression chamber 9 via the throat 3*a*. Accordingly, as the pressure value in the compression chamber 9 becomes its peak before the final stage of the interruption operation, the compression value is off-peak at this time. Further, the interruption-part movable portion by the operator has been sufficiently accelerated and moved in the interruption direction. Accordingly, even when a downsized operator is employed by reducing the operation counterforce with the control of the link mechanism 18 and the piston 6 as described above, the quenching gas compression in the compression chamber 9 from the final stage of the interruption operation can be easily performed. Thereafter, the interruption current becomes the arc current zero point and interrupted.

Figure 4:
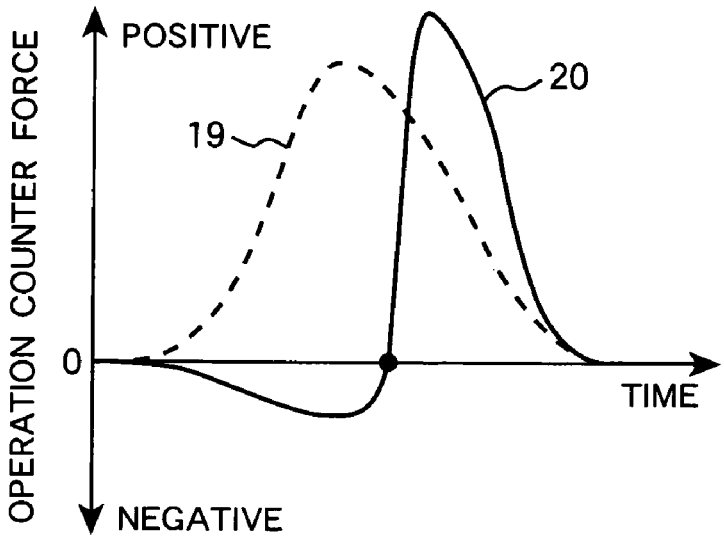
FIG. 4 is a graph showing a pressure rise characteristic in a compression chamber of the puffer type gas circuit breaker in FIG. 1.

FIG. 4 is a graph showing the characteristics of changes of the operation counterforce upon interruption operation of the above-described puffer type gas circuit breaker.

An operation counterforce curve 19 indicates time variation of the operation counterforce by the conventional mechanical compression. In the conventional puffer type gas circuit breaker, as the piston of the compression chamber is fixed, when the puffer cylinder moves in an interruption direction, the quenching gas in the compression chamber is compressed, and further, a pressure rise in the compression chamber due to the heat of arc generated by the arc contact opening is added, and this pressure acts as the operation counterforce to the operator to move the puffer cylinder in the interruption direction. Accordingly, a large-sized operator is required so as to generate a powerful operation force from the initial stage to overwhelm the operation counterforce.

On the other hand, an operation counterforce curve 20 indicates the operation counterforce in the puffer type gas circuit breaker according to the present embodiment. That is, as the puffer cylinder 5 and piston 6 both move in the interruption direction while maintaining an almost constant distance between the puffer cylinder and the piston from the initial stage of the interruption operation to the intermediate stage of the interruption operation, the pressure in the compression chamber 9 does not become an operation counterforce to the operator. At the final stage of the interruption operation, the mechanical compression of the quenching gas in the compression chamber 9 is performed. As indicated with the operation counterforce curve 20, at the final stage of the interruption operation, as the movement of the interruption-part movable portion in the interruption direction has been sufficiently accelerated and the fixed arc contact 1 has been removed from the throat 3*a* of the insulating nozzle 3, a rapid pressure rise in the compression chamber 9 can be obtained by the mechanical compression even with a small operator. Accordingly, as the operator employed in the present embodiment may be a small and low-operation force operator in place of the conventional operator which generates a powerful operation force from the initial stage of the interruption operation.

Next, the operation counterforce curve 20, indicating that the operation counterforce is negative by the intermediate stage of the interruption operation, will be described with reference to FIG. 2.

As described above, even when a large pressure rise occurs in the compression chamber 9, as the puffer cylinder 5 and piston 6 both move in the interruption direction while maintaining an almost constant distance between the puffer cylinder and the piston, the pressure rise does not become an operation counterforce to the operator. When a received pressure from the pressure in the compression chamber 9 acts on the piston 6, the piston 6 receives a driving force in the interruption direction. The piston 6 is movable in the interruption direction, and is mechanically connected via the link mechanism 18 with the center shaft 5*a*.

Accordingly, the driving force to the piston 6 acts to drive the center shaft 5*a* in the interruption direction via the link mechanism 18, to apply a force in the interruption direction to the operator. The operation counterforce curve 20 indicates that the operation counterforce is negative until the intermediate stage of the interruption operation. In other words, as the piston 6 is movable in a direction to enlarge the volumetric capacity in the compression chamber 9 by the pressure in the compression chamber 9, and as the link mechanism 18 transmits the force in the interruption direction to the part connected with the operator when the piston 6 moves in the direction to enlarge the volumetric capacity in the compression chamber 9, in a case where an extreme pressure rise has occurred in the compression chamber 9 by an arc, even when the received pressure by the pressure rise acts on the piston 6, the link mechanism 18 transmits the force in the interruption operational direction to the part connected with the operator, and the pressure rise does not become load on the interruption operation force by the operator. Accordingly, the operator can be downsized and the operation force can be reduced in comparison with the conventional operator, and the pressure rise due to the heat of arc can be utilized in the gas blast.

Figure 5:
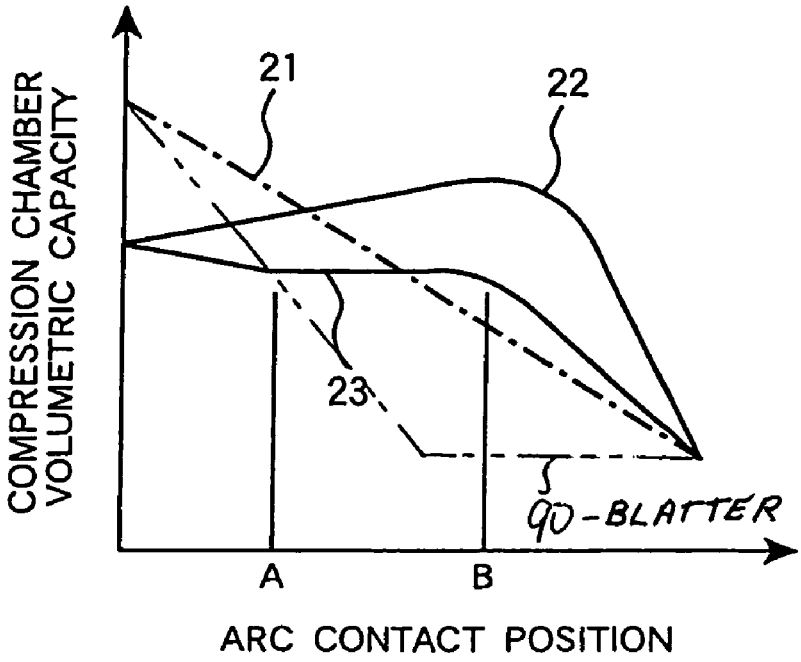
FIG. 5 is a graph showing a volumetric capacity change characteristic in the compression chamber of the puffer type gas circuit breaker in FIG. 1.

FIG. 5 is a graph showing the characteristics of changes of the volumetric capacity in the compression chamber 9 of the above-described puffer type gas circuit breaker upon interruption operation.

As indicated with a characteristic curve 21, when the conventional simple mechanical compression is performed, the volumetric capacity in the compression chamber is linearly reduced in accordance with the interruption operation. On the other hand, as indicated with a characteristic curve 22, in a case where the puffer cylinder 5 and piston 6 are driven in the interruption direction while a predetermined distance is maintained between the puffer cylinder and the piston by using the link mechanism 18 from the initial stage of the interruption operation to the intermediate stage of the interruption operation, as in the case of the puffer type gas circuit breaker in FIG. 1, a constant volumetric capacity in the compression chamber 9 is maintained at the initial stage of the interruption operation and the intermediate stage of the interruption operation before the fixed arc contact 1 moves to a position B where it is almost removed from the throat 3*a* of the insulating nozzle 3, and at the final stage of the interruption operation where the fixed arc contact 1 was moved to the position B where it is almost removed from the throat 3*a* of the insulating nozzle 3, as the interruption-part movable portion has already been sufficiently accelerated and driven in the interruption direction, the volumetric capacity in the compression chamber 9 is quickly reduced.

The pressure rise curve 20 in FIG. 4 differs to some degree in accordance with particular structure of the link mechanism 18 having the lever 16 and the link 17. As the link mechanism 18, almost the same advantage can be obtained by driving the piston 6 in the interruption direction at approximately the same speed as that of the puffer cylinder 5 at the initial stage of the interruption operation, or by driving the piston 6 in the interruption direction at a speed somewhat slower than that of the puffer cylinder 5 at the initial stage of the interruption operation.

A characteristic curve 23 in FIG. 5 indicates a case where the lever ratio or the like of the link mechanism 18 is selected so as to drive the piston 6 in the interruption direction at a speed somewhat slower than that of the puffer cylinder 5 at the initial stage of the interruption operation. In this case, the volumetric capacity in the compression chamber 9 is somewhat reduced from the start of the interruption operation before the fixed arc contact 1 moves to a position A where it is moved away from the movable arc contact 2, however, the change of the volumetric capacity is within a range of the construction to drive the puffer cylinder 5 and the piston 6 both in the interruption direction while maintaining an almost constant distance between the puffer cylinder and the piston. By using this link mechanism 18, almost the same advantage as that obtained by the above-described embodiment can be obtained. However, the slower the movement of the piston 6 in the interruption direction at the initial stage of the interruption operation is, the closer the pressure rise characteristic in the compression chamber 9 becomes to the conventional characteristic. Accordingly, it is preferable that the link mechanism 18 is designed so as to have a an intermediate characteristic between the characteristic curve 22 and the characteristic curve 23 in FIG. 5.

In the above-described puffer type gas circuit breaker, the link mechanism 18 is provided in the portion connected with the operator, e.g., between the center shaft 5*a* and the piston 6 which has conventionally been a fixed member, and the piston 6 is driven with the link mechanism 18 in the interruption direction. In this construction, the puffer cylinder 5 and the piston 6 are both driven in the interruption direction, and by various consideration of he operation characteristic of the piston 6, the operation counterforce to the operator can be reduced while the gas pressure in the compression chamber 9 due to the heat of arc is accumulated. Thus, the operator of the puffer type gas circuit breaker, which has conventionally required a powerful operation force from the start of the interruption operation, can be downsized and its operation force can be reduced. Accordingly, a puffer type gas circuit breaker having excellent interruption performance which holds a high pressure in a stable manner can be obtained.

Further, in the embodiment, as the puffer cylinder 5 and the piston 6 are driven in the interruption direction while a predetermined distance is maintained between the puffer cylinder 5 and the piston 6 before the fixed arc contact 1 is removed from the throat 3*a* of the insulating nozzle 3, even when a pressure rise occurs in the compression chamber 9 due to the heat of arc, the pressure rise does not become an operation counterforce to the operator. Further, the movement in the interruption operational direction is sufficiently accelerated by the interruption operation of the interruption-part movable portion and the subsequent compression of the quenching gas in the compression chamber 9 is effectively performed, the operator of the puffer type gas circuit breaker, which has conventionally required a powerful operation force from the start of the interruption operation, can be downsized and its operation force can be reduced. Accordingly, a puffer type gas circuit breaker having excellent interruption performance which holds a high pressure in a stable manner can be obtained.

Further, in the puffer type gas circuit breaker according to the above-described embodiment, the link mechanism 18 is provided in the portion connected with the operator, e.g. between the center shaft 5*a* and the piston 6 which has conventionally been a fixed member, and the piston 6 are driven in the interruption direction while a predetermined distance is maintained between the puffer cylinder 5 and the piston 6 with the link mechanism 18 before the fixed arc contact 1 is removed from the throat 3*a* of the insulating nozzle 3, even when a pressure rise due to the heat of arc occurs in the compression chamber 9, it does not become an operation counterforce to the operator. Further, the movement in the interruption direction is sufficiently accelerated by the interruption operation of the interruption-part movable portion at this time and the subsequent compression of the quenching gas in the compression chamber 9 is effectively performed, the operator of the puffer type gas circuit breaker, which has conventionally required a powerful operation force from the start of the interruption operation, can be downsized and its operation force can be reduced. Accordingly, a puffer type gas circuit breaker having excellent interruption performance which holds a high pressure in a stable manner can be obtained.

In the embodiment, the puffer cylinder 5 and the piston 6 are driven both in the interruption direction while the predetermined distance between the puffer cylinder and the piston is maintained with the link mechanism 18 from the initial stage of the interruption operation to the intermediate stage of the interruption operation. If the link mechanism 18 is designed so as to produce the same status during at least a part of the interruption operation until the fixed arc contact 1 is removed from the throat 3*a* of the insulating nozzle 3, the operator can be downsized and the operation force can be reduced for the same reason. Further, during the above status, as the pressure rise due to the heat of arc can be accumulated in the compression chamber 9 and can be utilized in the subsequent blast. Accordingly, a puffer type gas circuit breaker having excellent interruption performance which holds a high pressure in a stable manner can be obtained.

Especially in the case where the link mechanism 18 drives the puffer cylinder 5 and the piston 6 in the interruption direction while almost maintaining the predetermined distance between the puffer cylinder and the piston is performed from the initial stage of the interruption operation, the operation counterforce to the operator which rapidly increases at the initial stage of the interruption operation can be greatly reduced, and the operator of the puffer type gas circuit breaker to perform quenching gas compression can be downsized and its operation force can be reduced. To maintain the status where the puffer cylinder 5 and the piston 6 are driven in the interruption direction while the almost predetermined distance between the puffer cylinder and the piston is maintained by the intermediate stage of the interruption operation, it is necessary to set the size of the link mechanism 18 to attain the purpose. However, as a long stroke to hold the above status can be obtained until the fixed contact 1 has been removed from the throat 3*a* by adding a step of moving the piston 6 at a speed higher than that of the puffer cylinder 5 at the initial stage of the interruption operation as shown in the figure, the link mechanism 18 can be downsized.

Further, if the above-described link mechanism 18 is arranged so as to control the movement of the piston 6 to compress the quenching gas in the compression chamber 9 when the fixed arc contact 1 has been removed from the throat 3*a* of the insulating nozzle 3, the quenching gas in the compression chamber 9 can be compressed after the removal of the fixed arc contact 1 from the throat 3*a* of the insulating nozzle 3. A period to hold a high blast gas pressure in a stable manner can be increased. Accordingly, a puffer type gas circuit breaker having excellent interruption performance can be obtained.

Further, the piston 6 is movable in a direction to enlarge the volumetric capacity in the compression chamber 9 by the pressure in the compression chamber 9, and the link mechanism 18 is connected between the center shaft 5*a* and the piston 6 to transmit the force in the interruption operational direction to the part connected with the operator, e.g., the center shaft 5*a*, when the piston 6 has been moved in the direction to enlarge the volumetric capacity in the compression chamber 9. Accordingly, even when an extreme pressure rise occurs in the compression chamber 9 by an arc, the pressure rise does not become load on the interruption operation force by the operator. Accordingly, a downsized operator with a reduced operation force in comparison with the conventional operator can be employed.

Further, as the link mechanism 18 which drives the piston 6 with an operation characteristic different from that of the puffer cylinder 5 at the initial stage of the interruption operation is connected between the part connected with the operator and the piston 6, and the link mechanism 18 drives the piston 6 so as to increase the change rate of the volumetric capacity in the compression chamber in the compression direction, with respect to a moving distance of the part connected with the operator in the interruption direction at the final stage of the interruption operation, to be higher than that at the initial stage of the interruption operation, the change rate of the volumetric capacity in the compression chamber 9 in the compression direction can be reliably suppressed by the link mechanism 18, and a rapid pressure rise at the initial stage of the interruption operation can be suppressed. The operation counterforce to the operator which has conventionally occurred at the initial stage of the interruption operation and the intermediate stage of the interruption operation can be reduced, and the operator can be downsized and its operation force can be reduced. Further, at the final stage of the interruption operation, as the change rate of the volumetric capacity in the compression chamber in the compression direction can be reliably increased with the link mechanism and sufficient blast can be obtained at the final stage of the interruption operation, a period to hold a high blast gas pressure in a stable manner can be increased. Accordingly, a puffer type gas circuit breaker having excellent interruption performance can be obtained.

Further, as the link mechanism 18 drives the piston 6 so as to increase the change rate of the volumetric capacity in the compression chamber 9 in the compression direction, with respect to a moving distance of the part connected with the operator in the interruption direction at the final stage of the interruption operation where the fixed arc contact 1 is almost removed from the throat 3*a* of the insulating nozzle 3, to be higher than that at the initial stage of the interruption operation, when the fixed arc contact 1 has been almost removed from the throat 3*a* of the insulating nozzle 3 and a blast gas flow is generated, at the final stage of the interruption operation where the pressure value in the compression chamber 9 is off-peak, the change rate of the volumetric capacity in the compression chamber 9 in the compression direction can be reliably increased with the link mechanism 18 without increase in the operation force, and sufficient blast can be obtained at the final stage of the interruption operation. A period to hold a high blast gas pressure in a stable manner can be increased. Accordingly, a puffer type gas circuit breaker having excellent interruption performance can be obtained.

Figure 6:
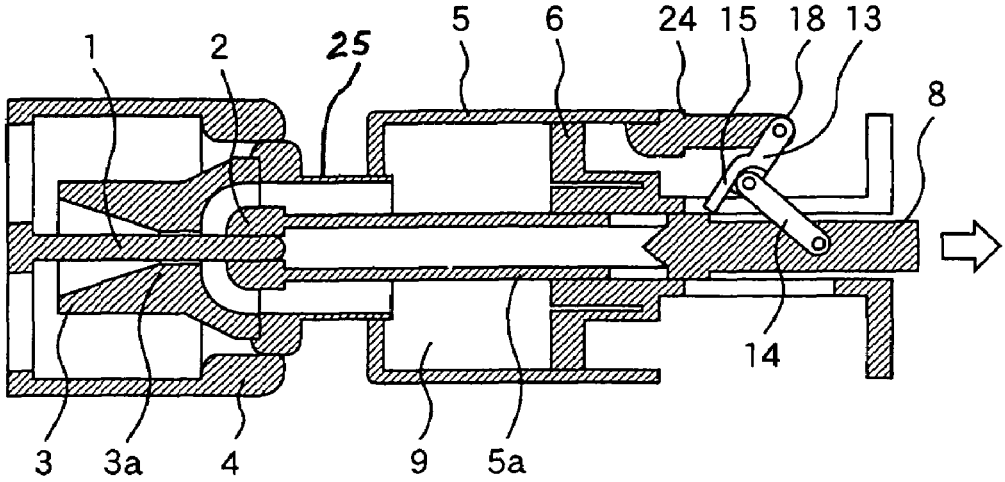
FIG. 6 is a cross-sectional view showing an initial status of the puffer type gas circuit breaker according to another embodiment of the present invention.

FIG. 6 is a cross-sectional view of the puffer type gas circuit breaker according to another embodiment of the present invention. In FIG. 6, constituent elements corresponding to those in the previous embodiment have the same reference numerals, and the detailed explanations thereof will be omitted.

As in the case of the previous embodiment, the link mechanism 18 is provided between the center shaft 5*a* of the puffer cylinder 5 and the piston 6, however, the link mechanism 18 of the present embodiment has a link 14 with its one end connected with the center shaft 5*a*, a link 13 with its intermediate portion rotatably connected with the other end of the link 14, and a support member 24 with its one end connected with the link 13 rotatably and its other end fixed to the piston 6. The link 13 has a stopper mechanism 15 to, when the link 13 rotates with a connecting portion to the support member 24 as a center in a counterclockwise direction, to stop further rotation in the counterclockwise direction by contact between the other end of the link 13 and the link 14. Further, a cylindrical member 25 which is integrally formed with the movable main contact 7 and which extends coaxially with the center shaft 5*a* is connected with the base side of the insulating nozzle 3 connected with the center shaft 5*a* of the puffer cylinder 5. The movable main contact 7 is arranged at a left end of the cylindrical member 25, and a right end of the cylindrical member 25 is slidably engaged with the puffer cylinder 5. At the initial status in FIG. 6, the link 14 drives the link 13 in a clockwise direction with the connecting portion between the link 13 and the support member 24 as a center, thereby the slidable portion of the puffer cylinder 5 is positioned little to the right side of the cylindrical member 25.

When the insulating rod 8 is driven by the operator (not shown), first, the movable main contact 7 is moved away from the fixed main contact 4, then the movable arc contact 2 is moved away from the fixed arc contact 1. At this time, in accordance with the movement of the center shaft 5*a* in the interruption direction, the link 14 also moves in the same direction, and applies a rotation force to the link 13 in the counterclockwise direction with the connecting portion with the support member 24 as a center. The rotation of the link 13 in the counterclockwise direction drives the puffer cylinder 5 in a leftward direction by received pressure. Accordingly, the slidable portion of the puffer cylinder 5 slides on an outer peripheral surface of the cylindrical member 25 to a position little to the left side. Accordingly, as shown in FIG. 7, at the initial stage of the interruption operation until the movable arc contact 2 has been moved away from the fixed arc contact 1, i.e., moved to the position A, the volumetric capacity in the compression chamber 9 is slightly enlarged or almost the same volumetric capacity as that in the initial status is maintained.

Accordingly, as in the case of the previous embodiment, the condition that, before the fixed arc contact 1 is removed from the throat 3*a* of the insulating nozzle 3 with the link mechanism 18 by the interruption operation, the puffer cylinder 5 and the piston 6 are driven both in the interruption direction while a predetermined distance between the piston and the puffer cylinder is almost maintained, is satisfied. As the pressure in the compression chamber 9 during this time does not become an operation counterforce to the operator, a small operator with a low operation force can be employed. Thereafter, the above status is maintained until the arc contact comes to the position B where the fixed arc contact 1 is removed from the throat 3*a* of the insulating nozzle 3.

Figure 7:
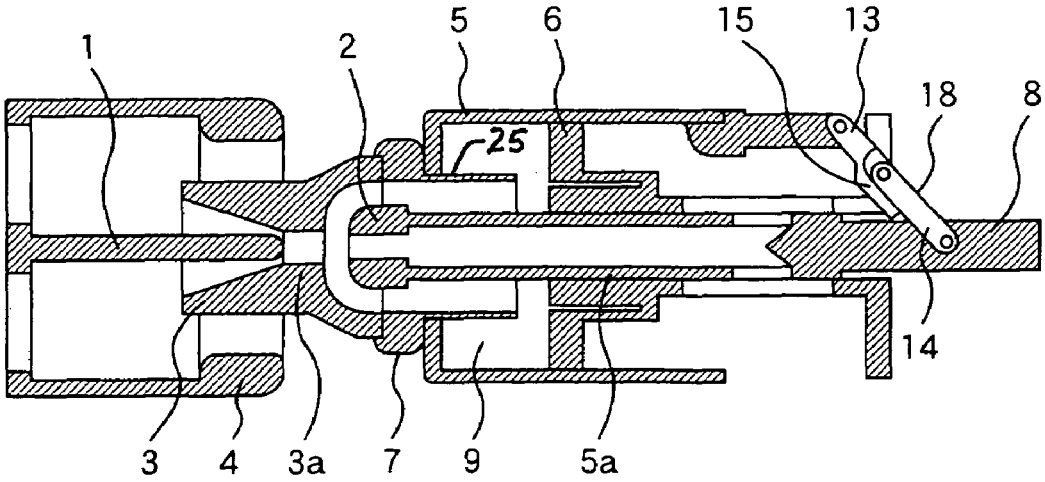
FIG. 7 is a cross-sectional view showing a final status of the interruption operation by the puffer type gas circuit breaker in FIG. 6.

Then, at the final stage of the interruption operation where the arc contact comes to the position B where the fixed arc contact 1 is almost removed from the throat 3*a* of the insulating nozzle 3, the stopper mechanism 15 of the link 13 on the free end side comes into contact with the link 14, which stops the rotation in the counterclockwise direction as shown in FIG. 7. At this time, the puffer cylinder 5 is directly connected with the center shaft 5*a*, and then the both members integrally move in the interruption direction. From this time of the final stage of the interruption operation, the distance between the puffer cylinder 5 and the piston 6 is reduced, thus the quenching gas in the compression chamber 9 is mechanically compressed. Upon execution of compression of the quenching gas in the compression chamber 9, the fixed arc contact 1 is out of the throat 3*a* of the insulating nozzle 3 and the pressure value in the compression chamber 9 is off-peak. Further, as the interruption-part movable portion has been sufficiently accelerated in the interruption direction with the operator, the gas compression in the compression chamber 9 can be effectively performed with a comparatively low operation force as in the case of the previous embodiment.

In the puffer type gas circuit breaker according to the present embodiment, as the link mechanism 18 is provided to drive the puffer cylinder 5 and the piston 6 both in the interruption direction while maintaining them in predetermined positions so as not to greatly change the volumetric capacity in the compression chamber 9, even when a pressure rise by the heat of arc occurs in the compression chamber 9, almost no operation counterforce acts on the operator. Accordingly, in comparison with the conventional operator which performs mechanical compression in the compression chamber 9 in a status where a pressure rise by the heat of arc has occurred in the compression chamber 9, a small operator with a low operation force can be employed. Further, as the step of compressing the quenching gas in the compression chamber 9 after the removal of the fixed arc contact 1 from the throat 3*a* of the insulating nozzle 3 is included, a period where a high blast gas pressure is maintained in a stable manner is increased, and a puffer type gas circuit breaker having excellent interruption performance can be obtained. As it is understood from the descriptions of these embodiments, as the link mechanism 18, which drives the puffer cylinder 5 and the piston 6 both in the interruption direction while maintaining them in predetermined positions so as not to greatly change the volumetric capacity in the compression chamber 9, various constructions may be adopted.

Figure 8:
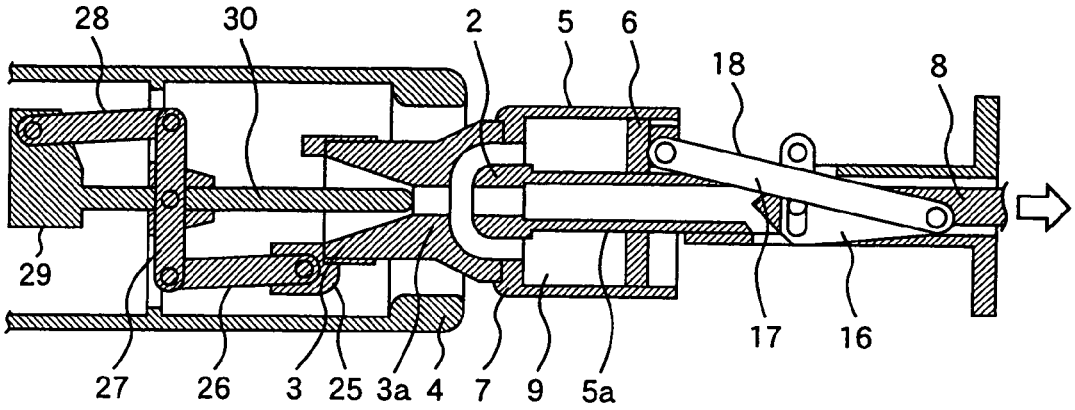
FIG. 8 is a cross-sectional view of the puffer type gas circuit breaker according to yet another embodiment of the present invention.

FIG. 8 is a cross-sectional view of the puffer type gas circuit breaker according to another embodiment of the present invention. In FIG. 8, constituent elements corresponding to those in the previous embodiment have the same reference numerals, and the detailed explanations thereof will be omitted.

In the puffer type gas circuit breaker, the movable side has almost the same structure as that in the embodiment shown in FIG. 1, however, the fixed side has a different structure.

In the previous embodiment, an arc contact is formed with the fixed arc contact 1 and the movable arc contact 2 to generate an arc upon contact opening. In the present embodiment, a first arc contact 2 is employed as the movable arc contact, and a movable second arc contact 30 is employed as the fixed arc contact. A link drive mechanism connects the interruption-part movable portion connected with the operator with the second arc contact 30, so as to transmit an operation force to drive the second arc contact 30 to move away from the first arc contact 2.

The link drive mechanism has a fixed member 25 attached to a position not to influence the blast gas flow in the insulating nozzle 3, a link 26 with its end connected with the fixed member 25, a lever 27 with its end connected with the other end of the link 26 and with its intermediate portion rotatably supported with an appropriate fixed member, and a movable member 29 connected via a link 28 with the other end of the lever 27. The second arc contact 30 corresponding to the fixed arc contact is connected with the movable member 29. the second arc contact 30 is driven in a direction of contact with the arc contact 2 by rotation of the lever 27 in the clockwise direction, and the second arc contact 30 is driven in a direction to move away from the arc contact 2 by rotation of the lever 27 in the counterclockwise direction.

When the operator (not shown) performs an interruption operation, the compression chamber 9 side operates as in the case of the previous embodiment shown in FIG. 1. At the initial stage of the interruption operation, when the insulating nozzle 3 is moved in the interruption direction, the lever 27 is rotated in the counterclockwise direction via the fixed member 25 and the link 26, to drive the movable member 29 in the leftward opening direction via the link 28. In accordance with this operation, the second arc contact 30 is also driven in the leftward opening direction, and a relative opening speed between the first arc contact 2 and the second arc contact 30 is increased.

In this manner, the rise of the operation speed at the initial stage of the interruption operation can be suppressed by increasing the relative opening speed between the first arc contact 2 and the second arc contact 30, and the operator itself can be downsized. Further, as the interruption performance can be improved, the compression chamber 9 formed with the puffer cylinder 5 and the piston 6 can be downsized as shown in FIG. 8. Further, as a predetermined opening distance at the final stage of the interruption operation can be ensured with the first arc contact 2 and the second arc contact 30, the opening operational distance of the first arc contact 2 is smaller than that in FIG. 1 and in accordance with the reduction of the opening operational distance, the link mechanism 18 can be downsized.

Although detailed illustrations are omitted in the present embodiment, the pressure rise characteristic in the compression chamber 9 by the puffer cylinder 5 and the timing at which the second arc contact 30 is removed from the throat 3*a* of the insulating nozzle 3 may be taken into consideration upon formation of a connecting portion with an elliptic hole as an allowance in the link drive mechanism to drive the second arc contact 30 or arbitrary selection of link ratio.

Generally, a puffer type gas circuit breaker has a compression device as a combination of a cylinder and a piston to compress the quenching gas in the compression chamber 9 in association with an interruption operation. It may be arranged such that anyone of the cylinder and the piston as the compression device is connected to the movable side. Further, as the link mechanism 18 to drive the piston 6 in the direction to enlarge the volumetric capacity in the compression chamber 9 or in the direction to prevent rapid compression from the initial stage to the intermediate stage of the interruption operation, any other construction than the illustrated constructions may be employed as long as the above-described operation characteristic can be satisfied.

The puffer type gas circuit breaker according to the present invention is applicable to any other puffer type gas circuit breaker than those described in the above embodiments.

What is claimed is:

1. A method of interrupting current of a puffer type gas circuit breaker having at least a pair of arc contacts connected to an operator, the method comprising: by means of the operator, compressing arc quenching gas in a compression chamber formed by a cylinder and piston upon a separation movement of the arc contacts, one of which is slidably connected to the cylinder and piston and blasting the compressed gas guided through an insulating nozzle towards an arc generated between the arc contacts thereby interrupting the current, said method furthercomprising, before blasting the arc quenching gas, a holding step for moving the position of the compression chamber towards the interruption direction, while keeping the volume of the compression chamber substantially the same as when the gas circuit breaker is in an initial switched on state, and then a compressing step for compressing the arc quenching gas at a final stage of the interruption operation, followed by blasting the arc quenching gas, while reducing the volume of the compression chamber.

2. The current interruption method for a puffer-type gas circuit breaker according to claim 1, wherein a throat of the insulating nozzle is clogged with the other arc contact, and when the other arc contact is removed from the throat upon the interruption operation, a blast flow is formed via the throat, from the compression chamber, and wherein the holding step is performed for at least a part of a period before the other arc contact is removed from the throat.

3. The current interruption method for a puffer-type gas circuit breaker according to claim 1, wherein the holding step further includes a step of enlarging the volume of the compression chamber.

4. A puffer type gas circuit breaker comprising:

at least a pair of arc contacts, disposed in an airtight container filled with a quenching gas, the arc contacts being separable from each other;

an operator that drives at least one of the arc contacts in a separation direction;

compression means, slidably connected with one of a cylinder and a piston connected with the operator, for compressing the quenching gas in a compression chamber formed by the cylinder and piston, upon a separation operation between the arc contacts; and an insulating nozzle whose throat is substantially clogged with one of the arc contacts not connected to the cylinder nor to the piston, the insulating nozzle guiding the quenching gas compressed by the compression means to blast the quenching gas to an arc generated between the arc contacts, wherein a link mechanism is provided, one end of which is connected with the operator and the other end of which is connected with one of the cylinder and the piston, and wherein the link mechanism branches an operation force of the operator at an initial stage of an interruption operation, thereby keeping the volume of the compression chamber substantially the same as when the gas circuit breaker is in a switched on state and drives one of the cylinder and piston in an interruption operation direction, followed by almost stopping one of the cylinder and piston at a final stage of the interruption operation thereby compressing the arc extinguishing gas.

5. A puffer type gas circuit breaker comprising:

at least a pair of arc contacts, disposed in an airtight container filled with a quenching gas, the arc contacts being separable from each other;

an operator that drives at least one of the arc contacts in a separation direction;

compression means, slidably connected with one of a cylinder and a piston connected with the operator, for compressing the quenching gas in a compression chamber formed by an end wall of the cylinder and the piston, upon a separation operation during a contact opening operation between the arc contacts; and an insulating nozzle, a throat of which is clogged with the other arc contact not connected to the cylinder nor to the piston, the insulating nozzle guiding the quenching gas compressed by the compression means to blast the quenching gas to an arc generated between the arc contacts during the contact opening operation, wherein a link mechanism is provided between the operator and one of the cylinder and the piston, and wherein the link mechanism drives the cylinder and the piston both in an interruption direction during the contact opening operation while holding a predetermined distance between one of the end wall of the cylinder and the piston and the other of the end wall of the cylinder and the piston before the other arc contact not connected to the cylinder nor to the piston, is removed from the throat of the insulating nozzle upon the interruption operation at an initial stage of the contact opening operation.

6. The puffer type gas circuit breaker according to claim 5, wherein the link mechanism fixes the piston so as to compress the quenching gas in the compression chamber when the other arc contact is separated from the throat of the insulating nozzle.

7. A puffer type gas circuit breaker comprising:

at least a pair of arc contacts, disposed in an airtight container filled with a quenching gas, moved away from each other;

an operator that drives at least one of the arc contacts in an opening direction;

compression means, connected with one of a slidable cylinder and a piston connected with the operator, for compressing the quenching gas in a compression chamber formed with the cylinder and the piston, in accordance with an opening operation between the arc contacts; and an insulating nozzle that guides the quenching gas compressed by the compression means to blast the quenching gas to an arc generated between the arc contacts during the contact opening operation, wherein one of the cylinder and the piston is movable in a direction to enlarge a volumetric capacity in the compression chamber by a pressure in the compression chamber during the contact opening operation, and wherein a link mechanism that transmits a force in an interruption operational direction to a part connected to the operator when the other one of the cylinder and the piston moves in the direction to enlarge the volumetric capacity in the compression chamber, is connected between the part connected with the operator and the other one of the cylinder and the piston.

8. A puffer type gas circuit breaker comprising:

at least a pair of arc contacts, disposed in an airtight container filled with a quenching gas, away from each other;

an operator that drives at least one of the arc contacts in an opening direction;

compression means, connected with one of a slidable cylinder and a piston connected with the operator, for compressing the quenching gas in a compression chamber formed with the cylinder and the piston, in accordance with an opening operation between the arc contacts; and an insulating nozzle that guides the quenching gas compressed by the compression means to blast the quenching gas to an arc generated between the arc contacts, wherein a link mechanism that drives other one of the cylinder and the piston with an operation characteristic different from that for the one of the cylinder and the piston at an initial stage of an interruption operation, is connected between a part connected with the operator and the other one of the cylinder and the piston, and wherein the link mechanism drives the other one of the cylinder and the piston so as to increase a change rate of the volumetric capacity in a compressing direction in the compression chamber, with respect to a distance of moving of a part connected with the operator in an interruption direction at a final stage of the interruption operation, to a higher rate than that at the initial stage of the interruption operation.

9. The puffer type gas circuit breaker according to claim 8, wherein the link mechanism drives the other one of the cylinder and the piston so as to increase a change rate of the volumetric capacity in a compressing direction in the compression chamber, with respect to a distance of moving of the part connected with the operator in an interruption direction at a final stage of the interruption operation where the other arc contact is almost removed from the throat of the insulating nozzle, to a higher rate than that at the initial stage of the interruption operation.

10. The puffer type gas circuit breaker according to claim 4, wherein the one of the cylinder and the piston is the cylinder, and the other one of the cylinder and the piston is the piston.

11. The puffer type gas circuit breaker according to claim 4, wherein the link mechanism drives the other one of the cylinder and the piston to move a relative position to the one of the cylinder and the piston in an initial status in a direction to enlarge the volumetric capacity in the compression chamber to a larger capacity than that at the initial stage of the interruption operation.

12. The puffer type gas circuit breaker according to claim 5, wherein the link mechanism drives the other one of the cylinder and the piston to move a relative position to the one of the cylinder and the piston in an initial status in a direction to enlarge the volumetric capacity in the compression chamber to a larger capacity than that at the initial stage of the interruption operation.

13. The puffer type gas circuit breaker according to claim 6, wherein the link mechanism drives the other one of the cylinder and the piston to move a relative position to the one of the cylinder and the piston in an initial status in a direction to enlarge the volumetric capacity in the compression chamber to a larger capacity than that at the initial stage of the interruption operation.

14. The puffer type gas circuit breaker according to claim 4, wherein the link mechanism drives the other one of the cylinder and the piston so as to maintain an almost constant volumetric capacity in the compression chamber at an initial stage of the interruption operation and at an intermediate stage of the interruption operation.

15. The puffer type gas circuit breaker according to claim 5, wherein the link mechanism drives the other one of the cylinder and the piston so as to maintain an almost constant volumetric capacity in the compression chamber at an initial stage of the interruption operation and at an intermediate stage of the interruption operation.

16. The puffer type gas circuit breaker according to claim 6, wherein the link mechanism transmits an operation force of the operator in a direction to move the one arc contact from the other arc contact.

17. The puffer type gas circuit breaker according to claim 7, wherein the link mechanism transmits an operation force of the operator in a direction to move the one arc contact from the other arc contact.

18. A method of interrupting current of a puffer type gas circuit breaker having at least a pair of arc contacts connected to an operator, which comprises the following steps carried out by the operation of the operator:

(a) moving a position of a compression chamber constituted by a cylinder and a piston which slidably moves in the cylinder towards an interruption direction, keeping the volume of the compression chamber in which arc quenching gas is contained substantially constant, while separating a nozzle for blasting the arc quenching gas towards an arc generated between the arc contacts, from a main contact;

(b) holding the position of the piston and further moving the cylinder towards the interruption direction, while compressing the arc extinguishing gas in the compression chamber, thereby reducing the volume of the compression chamber; and (C) blasting the compressed gas guided through an insulating nozzle towards the arc generated between the arc contacts to interrupt current.

19. A puffer type gas circuit breaker comprising:

at least a pair of arc contacts, disposed in an airtight container filled with a quenching gas, the arc contacts being separable from each other;

an operator that drives at least one of the arc contacts in an interruption direction;

compression means, connected to the operator, for compressing the quenching gas;

an insulating nozzle, of which a throat is clogged with one of the arc contacts not connected to one of the cylinder or the piston; and a link mechanism, one end of which is connected to the operator and the other end of which is connected to the cylinder or the piston; and wherein the link mechanism branches an operation force of the operator at an initial stage of an interruption operation during a contact opening operation and drives the cylinder or the piston in the interruption direction while holding a predetermined distance between an end wall of the cylinder and the piston before the other arc contact not connected to any of the cylinder and the piston is separated from the throat of the insulating nozzle at a final stage of the interruption operation during the contact opening operation.

20. The puffer type gas circuit breaker according to claim 19, wherein the link mechanism performs an operation comprising (a) a moving step of moving the position of the compression chamber constituted by a cylinder and a piston which slidably moves in the cylinder towards the interruption direction, keeping the volume of the compression chamber substantially constant in which arc quenching gas is contained, while separating a nozzle for blasting the arc quenching gas towards an arc generated between the arc contacts from a main contact; (b) a holding step of holding the position of the piston and further moving the cylinder towards the interruption direction, while compressing the arc extinguishing gas in the compression chamber, thereby reducing the volume of the compression chamber; and (c) a blasting step of blasting the compressed gas guided through an insulating nozzle towards the arc generated between the arc contacts, to interrupt current.

21. The puffer type gas circuit breaker according to claim 4, wherein the link mechanism performs an operation comprising (a) a moving step of moving the position of the compression chamber constituted by a cylinder and a piston which slidably moves in the cylinder, towards the interruption direction, keeping the volume of the compression chamber substantially constant in which arc quenching gas is contained, while separating a nozzle for blasting the arc quenching gas towards an arc generated between the arc contacts from a main contact; (b) a holding step of holding the position of the piston and further moving the cylinder towards the interruption direction, while compressing the arc extinguishing gas in the compression chamber, thereby reducing the volume of the compression chamber; and (c) a blasting step of blasting the compressed gas guided through an insulating nozzle towards the arc generated between the arc contacts, to interrupt current.

22. The puffer type gas circuit breaker according to claim 5, wherein the link mechanism performs an operation comprising (a) a moving step of moving the position of the compression chamber constituted by a cylinder and a piston which slidably moves in the cylinder towards the interruption direction, keeping the volume of the compression chamber substantially constant in which arc quenching gas is contained, while separating a nozzle for blasting the arc quenching gas towards an arc generated between the arc contacts from a main contact; (b) a holding step of holding the position of the piston and further moving the cylinder towards the interruption direction, while compressing the arc extinguishing gas in the compression chamber thereby reducing the volume of the compression chamber; and (c) a blasting step of blasting the compressed gas guided through an insulating nozzle towards the arc generated between the art contacts to interrupt current.

* * * * *